US011583916B2

(12) United States Patent
Schaffert et al.

(10) Patent No.: US 11,583,916 B2
(45) Date of Patent: Feb. 21, 2023

(54) APPARATUS FOR STRAIGHTENING WIRE ENDS

(71) Applicant: Vitesco Technologies GmbH, Hannover (DE)

(72) Inventors: Jürgen Schaffert, Schwalbach a. Ts. (DE); Rüdiger Brandau, Schwalbach a. Ts. (DE); Rainer Lenz, Schwalbach a. Ts. (DE)

(73) Assignee: VITESCO TECHNOLOGIES GMBH, Hannover (DE)

( * ) Notice: Subject to any disclaimer, the term of this patent is extended or adjusted under 35 U.S.C. 154(b) by 0 days.

(21) Appl. No.: 17/046,931

(22) PCT Filed: Apr. 8, 2019

(86) PCT No.: PCT/EP2019/058782
§ 371 (c)(1),
(2) Date: Oct. 12, 2020

(87) PCT Pub. No.: WO2019/197323
PCT Pub. Date: Oct. 17, 2019

(65) Prior Publication Data

US 2021/0046539 A1 Feb. 18, 2021

(30) Foreign Application Priority Data

Apr. 13, 2018 (DE) ..... 10 2018 205 662.5

(51) Int. Cl.
*B21F 1/02* (2006.01)

(52) U.S. Cl.
CPC ..... *B21F 1/02* (2013.01)

(58) Field of Classification Search
CPC ..... B21F 1/02; B21F 23/00
USPC ..... 140/147; 72/31.03
See application file for complete search history.

(56) References Cited

U.S. PATENT DOCUMENTS 3,941,165 A * 3/1976 Bowden ..... H05K 13/026 140/147
4,106,532 A * 8/1978 Gubitose ..... H05K 13/026 140/147

FOREIGN PATENT DOCUMENTS

| | | |
|---|---|---|
| CN | 101252825 | 8/2008 |
| DE | 19927862 | 12/2000 |
| JP | S57929 | 1/1982 |
| JP | S60255224 | 12/1985 |
| JP | S6122236 | 2/1986 |
| JP | S6133725 | 2/1986 |
| JP | S6133725 A * | 2/1986 |

(Continued)

OTHER PUBLICATIONS

English translate (JPS6133725A), retrieved date Nov. 17, 2021.*

(Continued)

*Primary Examiner* — Adam J Eiseman
*Assistant Examiner* — Mohammed S. Alawadi
(74) *Attorney, Agent, or Firm* — Cozen O'Connor

(57) ABSTRACT

An apparatus for straightening wire ends of enamelled copper wires of electric motors has a clamping apparatus for clamping the wire ends and a straightening apparatus for straightening the wire ends protruding beyond the clamping apparatus. The clamping apparatus and the straightening apparatus each have two actuators with which clamping elements and straightening elements can be moved transversely with respect to the axis of the wire ends.

16 Claims, 3 Drawing Sheets

(56) References Cited

FOREIGN PATENT DOCUMENTS

JP 2008205349 A * 9/2008

OTHER PUBLICATIONS

English translate (JP2008205349A), retrieved date Apr. 7, 2022.*
Office Action dated Dec. 3, 2021 issued in Chinese Patent Application No. 201980025773.6.

* cited by examiner

APPARATUS FOR STRAIGHTENING WIRE ENDS

CROSS REFERENCE TO RELATED APPLICATIONS

This is a U.S. national stage of Application No. PCT/EP2019/058782 filed Apr. 8, 2019. Priority is claimed on German Application No. DE 10 2018 205 662.5 filed Apr. 13, 2018 the content of which is incorporated herein by reference.

BACKGROUND OF THE INVENTION

Field of the Invention

The invention relates to an apparatus for straightening wire ends, in particular wire ends of enameled copper wires of a coil arrangement of electric motors.

Description of Related Art

In the case of small motors, such as are often used in motor vehicles, coils with protruding wire ends for an injection molding process are inserted into an injection molding die to produce a motor assembly. Since bent wire ends cannot be inserted into the injection molding die, a bell-shaped component is pushed over the wire ends by hand. The bell-shaped component straightens the wire ends and holds them in an intended position. A disadvantage here is that the bell-shaped component is a component to be manufactured in addition and requires a dedicated assembly step.

It is conceivable to straighten the wire ends using pliers. However, this leads to damage to the wire ends, in particular the enamel in the case of enameled copper wires.

SUMMARY OF THE INVENTION

One aspect of the invention is based on creating an apparatus with which a component to be assembled and with which damage to the wire ends can be avoided.

One aspect of the invention includes a clamping apparatus for clamping the wire ends and a straightening apparatus for straightening the wire ends protruding beyond the clamping apparatus.

By this configuration, the wire ends are initially held by the clamping device. By a corresponding configuration of the clamping device, damage, in particular in the case of enameled copper wires, is avoided. The wire ends can subsequently be straightened by the straightening device and thus brought into an intended shape. In this way, the wire ends are brought into an intended shape without the use of further components. The motor assembly having the coil arrangement can then be inserted into the injection molding die.

According to one aspect of the invention, the apparatus is particularly compact if the clamping apparatus and the straightening apparatus are arranged in two planes lying one above the other.

An electric motor usually has at least two wire ends that have to be straightened. According to one aspect of the invention, the apparatus permits rapid processing of a plurality of wire ends if the clamping apparatus and the straightening apparatus are designed for simultaneously clamping and straightening a plurality of wire ends.

According to one aspect of the invention, securing of the wires during straightening of the wire ends turns out to be particularly simple if the clamping apparatus has two clamping elements that are movable relative to one another between a clamping position and a release position, and if wire ends inserted in the clamping position are held in a force-fitting manner, and a force-fitting connection with inserted wire ends is released in the release position.

According to one aspect of the invention, uniform clamping of the wire ends can be ensured if the clamping elements are each connected to an actuator and are movable transversely with respect to the axis of the wire ends.

According to one aspect of the invention, the straightening of the wire ends is particularly simple if the straightening apparatus has two straightening elements movable relative to one another between a straightening position for bending or for straightening the wire ends and a release position. The straightening elements can be shaped accordingly for simultaneous processing of a plurality of wire ends.

In the structurally simplest case, one of the straightening elements is stationary and the other of the straightening elements is movable. However, this may lead to an undesirable loading of the wire ends. According to one aspect of the invention, the loading of the wire ends can be kept particularly low if the two straightening elements are each connected to an actuator and are movable transversely with respect to the axis of the wire ends. By this configuration, the straightening elements move toward one another and straighten the wire end, which is preferably held centrally by the clamping apparatus.

According to one aspect of the invention, lateral bending of the wire ends during straightening can be easily avoided if the straightening elements are configured in the shape of a prism. By this configuration, the wire end is guided into the intended shape.

According to one aspect of the invention, the apparatus can easily be converted for a plurality of wire ends, different shapes or for different cross sections of the wire ends if the straightening elements are fastened releasably in the straightening apparatus. This configuration permits the straightening elements to be exchanged and thus the straightening apparatus to be adapted to the number, the shape to be straightened and to the cross section of the wire ends. A screw connection is particularly suitable for the releasable fastening.

According to one aspect of the invention, the actuators for driving the straightening elements and the clamping elements can be arranged on one side if one of the straightening elements and one of the clamping elements is connected to the respective actuator via tie rods. By this configuration, the apparatus protrudes laterally beyond the coil arrangement, and therefore if a plurality of wire ends are to be straightened, a plurality of apparatuses can be coupled to one another. The apparatus thereby also turns out to be particularly compact.

BRIEF DESCRIPTION OF THE DRAWINGS

The invention permits numerous embodiments. To further illustrate its basic principle, aspects of the invention are illustrated in the drawings and will be described in the following text. In the drawing

DETAILED DESCRIPTION OF THE PRESENTLY PREFERRED EMBODIMENTS

Figure 1:
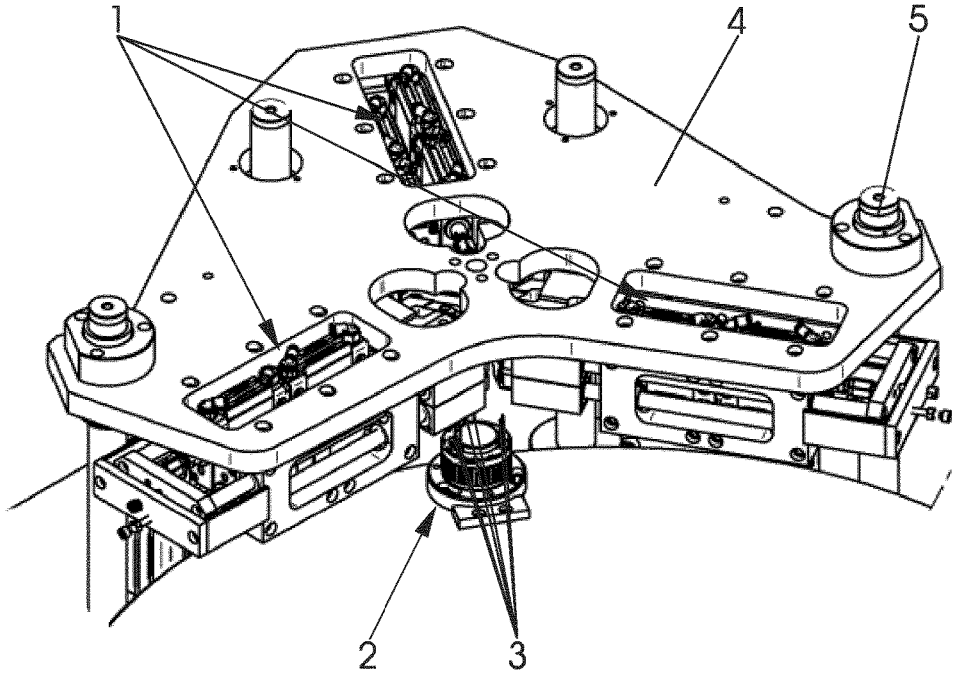
FIG. 1 is a perspective illustration of a straightening tool with three apparatuses for straightening wire ends.

FIG. 1 shows a straightening tool with three interconnected apparatuses 1 and a coil arrangement 2. The apparatuses serve to straighten wire ends 3 of the coil arrangement 2 before the coil arrangement 2 is placed into an injection molding die. The apparatuses 1 are connected to one another via an annular carrier 4 and can be pushed along a plurality of vertical guide columns 5 onto the wire ends 3 protruding from the coil arrangement 2, such that each of the apparatuses 1 receives two wire ends 3. The apparatuses 1 serve in each case for simultaneously clamping and straightening two wire ends 3. The coil arrangement 2 is part of a stator of a small electric motor, not illustrated, which is often used as a servomotor in motor vehicles nowadays.

Figure 2:
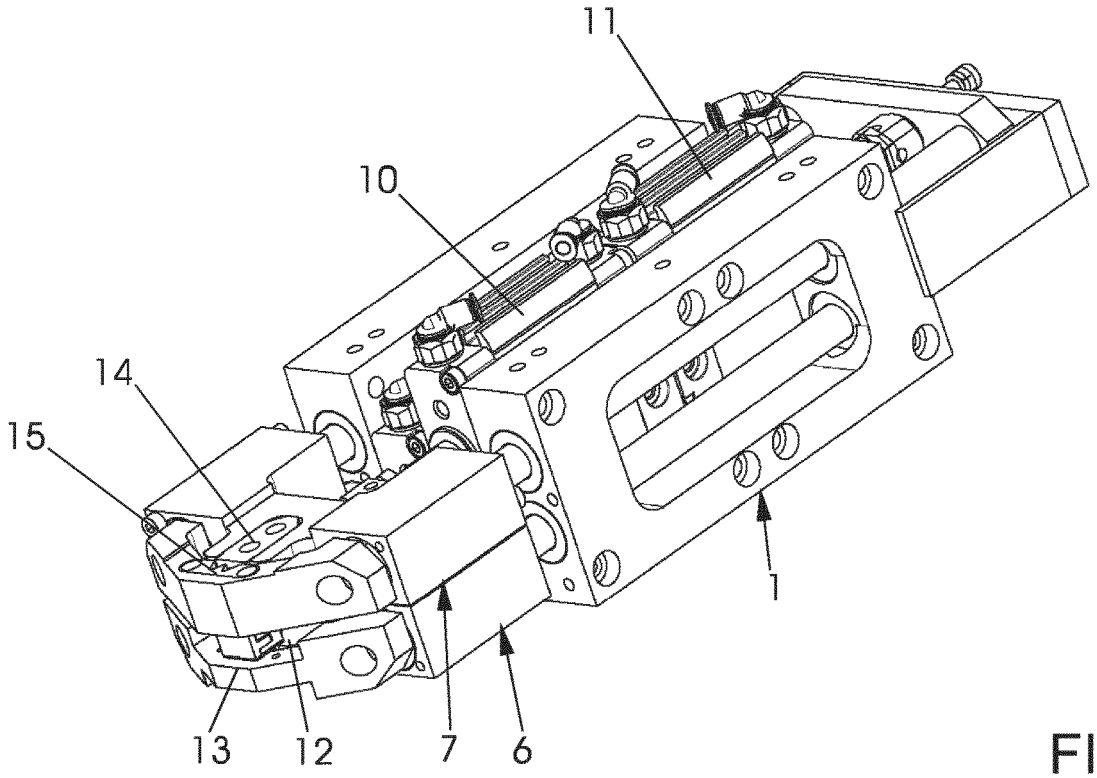
FIG. 2 is an enlarged perspective illustration of one of the apparatuses from FIG. 1.

FIG. 2 shows one of the apparatuses 1 from FIG. 1 in a perspective illustration. The apparatus 1 has a clamping apparatus 6 and a straightening apparatus 7. The clamping apparatus 6 serves for clamping the wire ends 3 at a distance from the free ends thereof, while the straightening apparatus 7 is arranged in a sandwich-like manner over the clamping apparatus 6 and is designed for straightening the free ends of the wire ends 3. The clamping apparatus 6 and the straightening apparatus 7 therefore rest in two planes lying one above another and each have two actuators 8-11 for driving clamping elements 12, 13 and straightening elements 14, 15. The actuators 8, 9 of the clamping apparatus 6 can be seen in a top view in FIG. 3. The actuators 8-11 are designed as double-action pneumatic cylinders and permit a movement of the clamping elements 12, 13 of the clamping apparatus 6 and of the straightening elements 14, 15 of the straightening apparatus 7 toward one another.

The actuators 8-11 designed as pneumatic cylinders permit the clamping elements 12, 13 or the straightening elements 14, 15 to be actively moved away from one another and actively moved toward one another, transversely with respect to the axes of the wire ends 3 illustrated in FIG. 1. Thus, when the clamping elements 12, 13 are moved toward one another, the wire ends 3 are held in a defined position in a force-fitting manner and can be straightened into the desired shape by the straightening elements 14, 15. Subsequently, straightening elements 14, 15 and clamping elements 12, 13 are moved away from one another and the coil arrangement 2 with the straightened wire ends 3 can be removed from the straightening tool.

Figure 3:
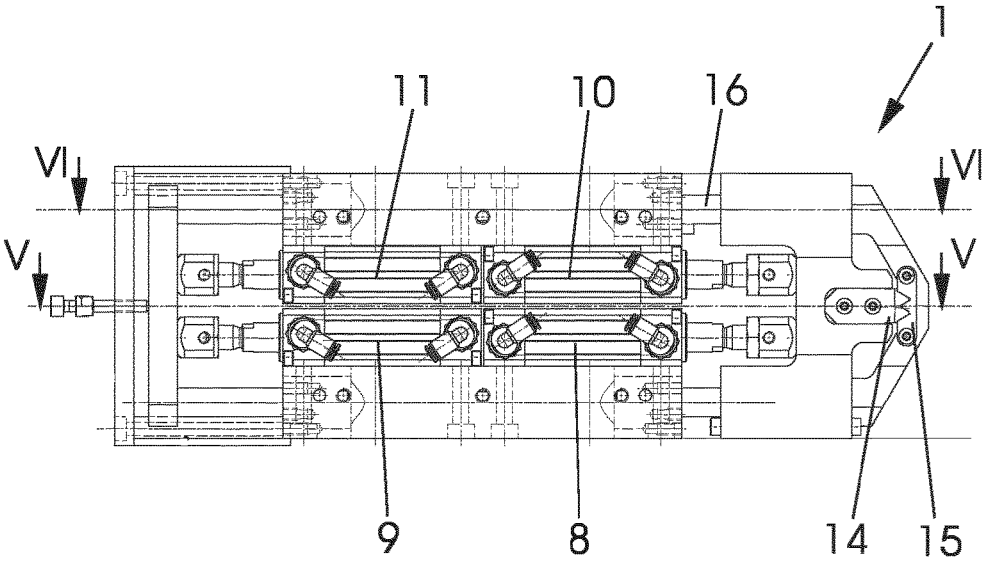
FIG. 3 is a top view of the apparatus from FIG. 1.

FIG. 3 shows, in a top view of the apparatus 1 from FIG. 1, that, in the straightening apparatus 7, the actuator 10 close to the straightening elements 14, 15 is directly connected to one of the straightening elements 14, while the actuator 11 remote from the straightening elements 14, 15 is connected to the second straightening element 15 via tie rods 16. The straightening elements 14, 15 are configured in the shape of a prism and are fastened releasably in the straightening apparatus 7. The straightening apparatus 7 can thus be converted, by exchanging the straightening elements 14, 15, for example for straightening one individual wire end 3 or three wire ends 3.

Figure 4:
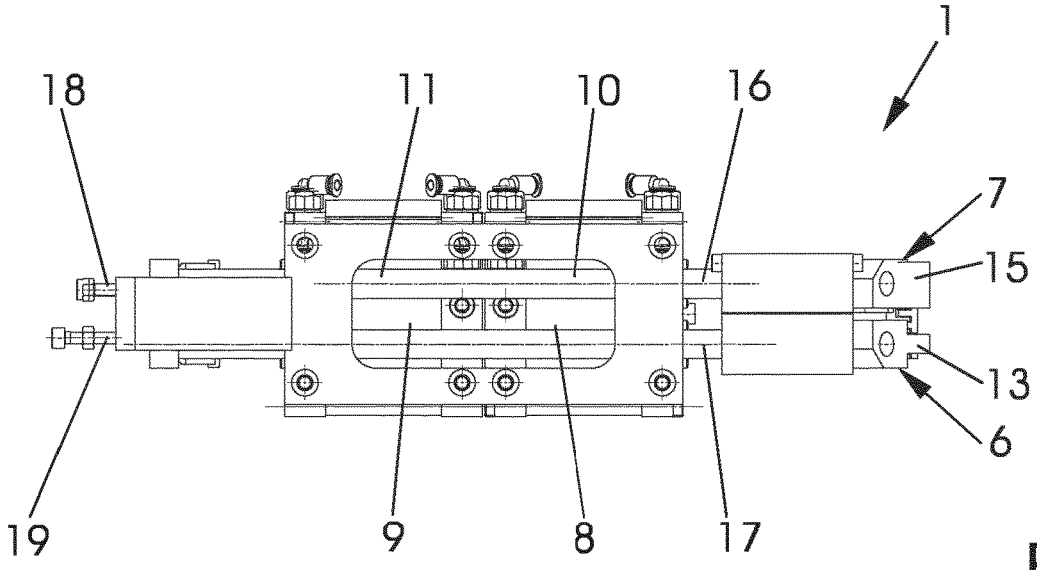
FIG. 4 is a side view of the apparatus from FIG. 1.

FIG. 4 shows, in a side view of the apparatus 1, that the clamping apparatus 6 is constructed analogously to the straightening apparatus 7 and likewise has tie rods 17 for connecting the one actuator 9 to the one clamping element 13. Furthermore, the clamping apparatus 6 and the straightening apparatus 7 each have adjusting screws 18, 19 for setting stops, not illustrated in detail, of the clamping element 13 and straightening element 15 connected to the tie rods 16, 17.

Figure 5:
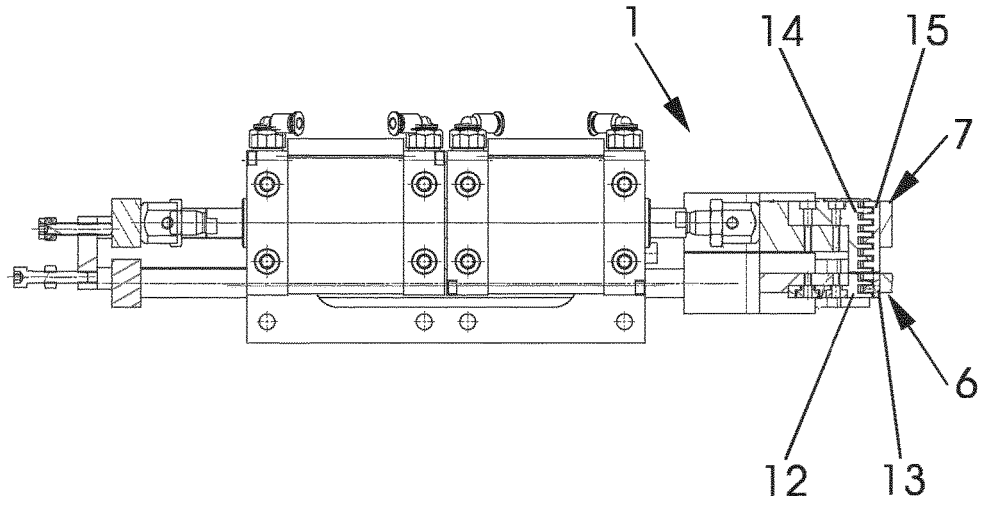
FIG. 5 is a sectional illustration of the apparatus from FIG. 3 along the line V-V.

FIG. 5 shows a central sectional illustration through the apparatus 1 from FIG. 3 along the line V-V. It can be seen here that the straightening elements 14, 15 intermesh in the manner of a comb. The wire ends 3 are thus guided into the intended shape. The clamping elements 12, 13 have small dimensions compared to the straightening elements 14, 15.

Figure 6:
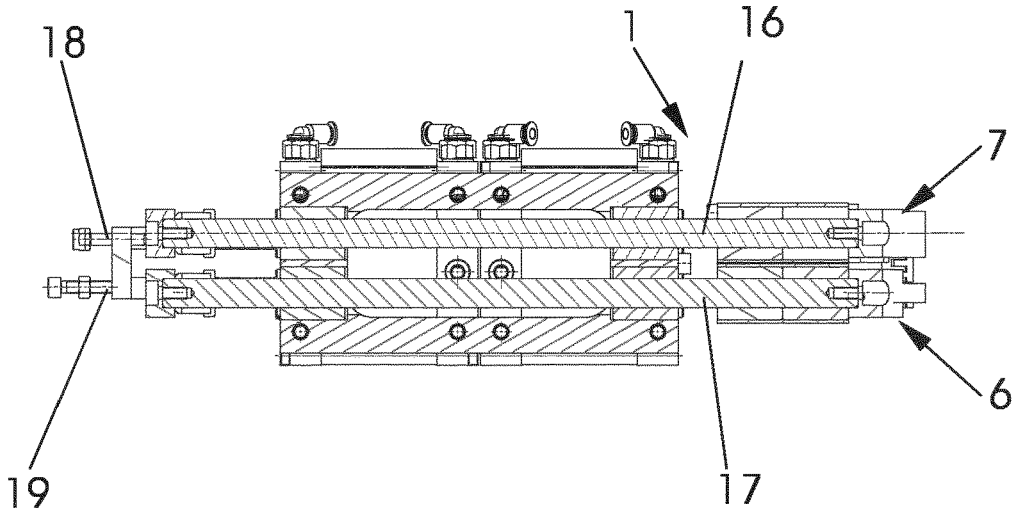
FIG. 6 is a sectional illustration of the apparatus from FIG. 3 along the line VI-VI.

For clarification, FIG. 6 shows a lateral sectional illustration through the apparatus 1 from FIG. 3 along the line VI-VI in the region of the tie rods 16, 17.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. An apparatus configured to straighten wire ends, comprising:

a clamping apparatus configured to clamp the wire ends, wherein the clamping apparatus has two clamping elements that are movable relative to one another between a clamping position and a release position, the clamping apparatus having a pair of opposed clamping regions, wherein at least one of the clamping regions has a first clamp driving region on a first lateral side of the at least one of the clamping regions and a second clamp driving region on a second lateral side of the at least one of the clamping regions opposite the first lateral side of the at least one of the clamping regions, wherein the at least one of the clamping regions is laterally arranged between the first clamp driving region and the second clamp driving region; and a straightening apparatus configured to straighten the wire ends protruding beyond the clamping apparatus and having two opposing straightening elements that mesh in a comblike manner, the straightening apparatus having a pair of opposed straightening regions, wherein at least one of the straightening regions has a first straightening driving region on a first lateral side of the at least one of the straightening regions and a second straightening driving region on a second lateral side of the at least one of the straightening regions opposite the first lateral side of the at least one of the straightening regions, wherein the at least one of the straightening regions is arranged laterally between the first straightening driving region and the second straightening driving region, wherein the two opposing straightening elements diverge from each other evenly, and wherein the two clamping elements of the clamping apparatus are movable independent of the two opposing straightening elements of the straightening apparatus.

2. The apparatus as claimed in claim 1, wherein the clamping apparatus and the straightening apparatus are arranged in two planes lying one above the other.

3. The apparatus as claimed in claim 1, wherein the clamping apparatus and the straightening apparatus are configured to simultaneously clamp and straighten a plurality of wire ends.

4. The apparatus as claimed in claim 1, wherein respective wire ends inserted in the clamping position are held in a force-fitting manner, and a force-fitting connection with inserted wire ends is released in the release position.

5. The apparatus as claimed in claim 4, wherein the driving regions of at least one of the two clamping elements are each connected to an actuator and are movable transversely with respect to an axis of the wire ends.

6. The apparatus as claimed in claim 4, wherein one of the straightening elements and one of the clamping elements are connected to a respective actuator via tie rods.

7. The apparatus as claimed in claim 1, wherein the two straightening elements are movable relative to one another between a straightening position for bending or for straightening the wire ends and a release position.

8. The apparatus as claimed in claim 7, wherein the two straightening elements are each connected to an actuator, and the clamping apparatus for clamping the wire ends and the straightening apparatus for straightening the wire ends protruding beyond the clamping apparatus are movable transversely with respect to an axis of the wire ends.

9. The apparatus as claimed in claim 7, wherein the two straightening elements are configured shaped as a prism.

10. The apparatus as claimed in claim 7, wherein the two straightening elements are fastened releasably in the straightening apparatus.

11. The apparatus as claimed in claim 1, wherein the wire ends are enameled copper wires of a coil arrangement of an electric motor.

12. The apparatus as claimed in claim 1, wherein the clamping apparatus and the straightening apparatus completely surround the wire ends.

13. The apparatus as claimed in claim 1, further comprising:

an annular carrier configured to hold three clamping and straightening apparatuses.

14. The apparatus as claimed in claim 13, wherein the three clamping and straightening apparatuses are offset from one another by about 120°.

15. The apparatus as claimed in claim 1, wherein the two straightening elements are each connected to a respective actuator, the actuators are arranged perpendicularly with respect to an axis of the wire ends and the straightening elements move perpendicularly with respect to the axis of the wire ends along a longitudinal axis of the actuators.

16. The apparatus as claimed in claim 1, further comprising:

adjusting screws for setting a respective stop for the clamping apparatus and the straightening apparatus.

* * * * *